US007477130B2

(12) United States Patent
Fukushige et al.

(10) Patent No.: US 7,477,130 B2
(45) Date of Patent: Jan. 13, 2009

(54) DUAL FUSE LINK THIN FILM FUSE

(75) Inventors: Yasuhiro Fukushige, Yokohama (JP); Pablo Wally, Yokohama (JP)

(73) Assignee: Littelfuse, Inc., Des Plaines, IL (US)

( * ) Notice: Subject to any disclaimer, the term of this patent is extended or adjusted under 35 U.S.C. 154(b) by 391 days.

(21) Appl. No.: 11/046,367

(22) Filed: Jan. 28, 2005

(65) Prior Publication Data

US 2006/0170528 A1 Aug. 3, 2006

(51) Int. Cl.
*H01H 85/04* (2006.01)

(52) U.S. Cl. ..... 337/297; 337/161; 337/293; 337/283; 337/284

(58) Field of Classification Search ..... 337/297, 337/283, 284, 293, 161, 271; *H01H 85/04, H01H 85/046, 85/024*
See application file for complete search history.

(56) References Cited

U.S. PATENT DOCUMENTS 3,358,363 A 12/1967 Jacks et al.
3,585,556 A * 6/1971 Hingorany et al. ..... 337/297
3,805,208 A 4/1974 McAlister
4,000,054 A 12/1976 Marcantonio
4,021,705 A * 5/1977 Lichtblau ..... 361/765
4,037,917 A * 7/1977 Clement ..... 439/831
4,149,137 A * 4/1979 Konnemann ..... 337/295
4,214,223 A * 7/1980 Kourimsky ..... 337/293
4,272,753 A 6/1981 Nicolay
4,296,398 A * 10/1981 McGalliard ..... 337/297
4,376,927 A * 3/1983 McGalliard ..... 337/297
4,394,639 A 7/1983 McGalliard
4,503,315 A 3/1985 Kamioka et al.
4,626,818 A 12/1986 Hilgers
4,630,355 A 12/1986 Johnson
4,635,023 A 1/1987 Oh
4,652,848 A * 3/1987 Hundrieser ..... 337/297
4,706,059 A * 11/1987 Schmitt ..... 337/297
4,873,506 A 10/1989 Gurevich
4,924,203 A 5/1990 Gurevich
5,025,300 A 6/1991 Billig et al.
5,091,712 A 2/1992 Suuronen
5,095,297 A 3/1992 Perreault et al.
5,097,247 A 3/1992 Doerrwaechter
5,099,219 A 3/1992 Roberts
5,115,220 A 5/1992 Suuronene et al.
5,140,295 A 8/1992 Vermot-gaud et al.
5,148,141 A 9/1992 Suuronen
5,303,402 A * 4/1994 McLaughlin et al. ..... 455/186.1
5,367,280 A 11/1994 Thiel et al.

(Continued)

FOREIGN PATENT DOCUMENTS

JP 56-160648 12/1981

(Continued)

*Primary Examiner*—Anatoly Vortman
(74) *Attorney, Agent, or Firm*—Bell, Boyd & Lloyd LLP

(57) ABSTRACT

A surface mount fuse having a plurality of fusible links is provided. The links are located on opposite sides of an insulative substrate or one otherwise thermally insulated or decoupled from one another. The fuse links entered to terminals that can be asymmetrically secured to the substrate to discourage improper mounting. The fuse protects multiple different circuits or loads having a same common or grounded line.

19 Claims, 6 Drawing Sheets

U.S. PATENT DOCUMENTS 5,373,414 A 12/1994 Kondo
5,420,455 A 5/1995 Gilmour et al.
5,453,726 A 9/1995 Montgomery
5,456,942 A 10/1995 Bebak et al.
5,469,981 A 11/1995 Srikishnan et al.
5,538,924 A 7/1996 Chen
5,543,774 A 8/1996 Lōf
5,552,757 A 9/1996 Blecha et al.
5,567,643 A 10/1996 Lee et al.
5,572,181 A 11/1996 Kiryu et al.
5,578,861 A 11/1996 Kinoshita et al.
5,585,662 A 12/1996 Ogawa
5,608,257 A 3/1997 Lee et al.
5,621,375 A 4/1997 Gurevich
5,625,218 A 4/1997 Yamadera et al.
5,625,219 A 4/1997 Takagi
5,640,761 A * 6/1997 DiStefano et al. ..... 29/830
5,712,610 A 1/1998 Takeichi et al.
5,726,621 A * 3/1998 Whitney et al. ..... 337/297
5,729,041 A 3/1998 Yoo et al.
5,747,868 A 5/1998 Reddy et al.
5,760,453 A 6/1998 Chen
5,790,008 A * 8/1998 Blecha et al. ..... 337/297
5,821,160 A 10/1998 Rodriquez et al.
5,844,477 A 12/1998 Blecha et al.
5,851,903 A 12/1998 Stamper
5,863,407 A 1/1999 Kiyokawa
5,869,383 A 2/1999 Chien et al.
5,872,389 A 2/1999 Nishimura et al.
5,872,390 A 2/1999 Lee et al.
5,879,966 A 3/1999 Lee et al.
5,888,851 A 3/1999 Motonami et al.
5,891,762 A 4/1999 Sakai et al.
5,895,262 A 4/1999 Becker et al.
5,923,239 A 7/1999 Krueger et al.
5,929,741 A * 7/1999 Nishimura et al. ..... 337/290
5,943,764 A 8/1999 Blecha et al.
5,961,808 A 10/1999 Kiyokawa
5,968,847 A 10/1999 Ye et al.
5,982,268 A 11/1999 Kawanishi
5,986,319 A 11/1999 Huggins
5,986,321 A 11/1999 Frochner
6,002,322 A 12/1999 Krueger et al.
6,010,966 A 1/2000 Ionov
6,040,754 A 3/2000 Kawanishi
6,043,966 A 3/2000 Krueger et al.
6,080,681 A 6/2000 Tabara
6,168,977 B1 1/2001 Konishi
6,180,503 B1 1/2001 Tzeng et al.
6,204,548 B1 3/2001 Komai
6,300,859 B1 * 10/2001 Myong et al. ..... 337/182
6,320,242 B1 11/2001 Takasu et al.
6,372,554 B1 4/2002 Kawakita et al.
6,372,652 B1 4/2002 Verma et al.
6,384,708 B1 * 5/2002 Jollenbeck et al. ..... 337/297
6,586,282 B1 7/2003 Takasu
6,809,626 B2 * 10/2004 Chu et al. ..... 337/167
2005/0003199 A1 * 1/2005 Takaya et al. ..... 428/413

FOREIGN PATENT DOCUMENTS

JP 57-117255 7/1982
JP 57-122565 7/1982
JP 1-272133 10/1989
JP 2-100221 4/1990
JP 4-65046 3/1992
JP 4-365351 12/1992
JP 7-6677 1/1995
JP 7-201263 8/1995
JP 7-201264 8/1995
JP 7-201265 8/1995
JP 8-77899 3/1996
JP 8-213216 8/1996
JP 9-115418 5/1997
JP 10-106425 4/1998

* cited by examiner

DUAL FUSE LINK THIN FILM FUSE

BACKGROUND OF THE INVENTION

The invention relates generally to circuit protection and more specifically to fuse protection.

Printed circuit boards ("PCB's") have found increasing application in electrical and electronic equipment of all kinds. It is the printed circuit board and the content that sits atop it that allow the electronic device to function. With cellular phones and other handheld electronic devices being designed and manufactured smaller and smaller the need to save space on the PCB is critical.

The electrical circuits formed on the PCB's, like larger scale, conventional electrical circuits, need protection against electrical overloads. In particular, circuit boards and other electrical circuits within the telecommunications industry need protection against electrical overload. This protection can be provided by subminiature fuses that are physically secured to the PCB.

Subminiature fuses used currently in industry typically provide overcurrent protection for a single circuit or conductive pathway. In many instances, multiple fuses must be used, consuming needed space on the PCB. A need therefore exists to save space on PCB's by reducing the number of fuses required to provide a sufficient amount of fuse protection.

Similar to the need to save board space, it is also desirable to provide components that are adaptable to meet different conditions or constraints posed by the PCB. PCB level fuses are typically rated for a single amperage. A need exists to provide increased flexibility with respect to fuse current ratings. Further, it is desirable to aid assemblers in placing only fuses having proper ratings into circuit.

SUMMARY OF THE INVENTION

The present invention provides a surface mountable fuse, which includes multiple fuse links secured to an insulative substrate. A single fuse of the present invention can protect multiple conductive pathways of a same circuit or multiple different circuits. The fuse links of the fuse can be rated the same or differently. If rated differently, the configurations of the fuse links are arranged in one embodiment so that the fuse cannot be mounted improperly (e.g. where the wrong fuse rating is mounted in a circuit).

The insulative substrate is made of any suitable material, such as FR-4, epoxy resin, ceramic, resin coated foil, teflon, polyimide, glass and any suitable combination thereof. The fuse link in one embodiment includes a copper trace as are the terminals. The terminals can be plated with multiple conducted layers such as additional copper layers, nickel layers, silver layers, gold layers and/or lead-tin layers. The fuse links extend to terminals, which are also plated or adhered to the insulative substrate.

The fuse links each include a fuse element. In one embodiment the fuse element is a lead-tin spot that is placed approximately at the center of each of the fuse links, between the respective terminals of the links. The lead-tin spot melts before the copper trace of the fuse link melts, causing the copper trace to heat quicker at the spot of the melted fuse element. The fuse link in turn opens at that desirable point.

The fuse links can be placed in a non-symmetrical relationship with one another, so that it is difficult if not impossible to mount the fuses improperly. Further, certain portions of the insulative substrate can be metallized in addition to the terminal and fuse link metallizations to help balance the fuse during soldering. In that way, potential unequal surface tension forces during soldering due to an unbalanced metallization pattern are balanced. Such additional metallizations can render the fuses of the present invention at least somewhat auto-alignable. The terminals are also structured so that diagnostic testing of the fuse can be performed without flipping the fuse, e.g., after the fuse is soldered to a PCB.

Multiple embodiments are disclosed for arranging the fuse links on the fuse body. Various embodiments include fuse links having an X-shaped relationship to one another, a parallel relationship, a perpendicular relationship or a cross-shaped relationship, for example.

In one embodiment, each fuse link extends to a unique pair of terminals. In another embodiment, the fuse links share one terminal, namely, a ground or common terminal.

The fuses in one embodiment are also provided with a protective coating that covers at least the fuse links and associated fuse elements, while exposing at least a portion of the terminals for soldering to a parent PCB. The coacting is for example an epoxy coating.

Still further, the present invention includes fuses having multiple substrates with a fuse link layer disposed between the substrates. In that way, a single fuse with three or more fuse links may be provided.

It is therefore an advantage of the present invention to provide a single device with multiple fuse links.

Another advantage of the present invention to provide an improved surface mountable fuse.

Moreover, it is an advantage of the present invention to protect multiple circuits or multiple conductive pathways of a single circuit.

It is yet another advantage of the present invention to provide a surface mountable fuse having additional metallized portions to improve manufacturability.

It is another advantage of the present invention to provide a fuse with multiple fuse links having different fuse ratings.

Yet an additional advantage of the present invention is to provide a surface mount fuse having dual-sided protection and a single side for diagnostic testing.

Further still, it is an advantage of the present invention to provide a multi-rated fuse with multiple fuse ratings and varied mounting footprints to prevent improper mounting.

It is yet another advantage of the present invention to provide a fuse with different fuse links, which are configured asymmetrically to prevent improper mounting of the fuse.

Still further, it is an advantage of the present invention to provide a multiple fuse link fuse with completely separate conductive paths or with a common line.

Additional features and advantages of the present invention are described in, and will be apparent from, the following Detailed Description of the Invention and the figures.

DETAILED DESCRIPTION OF THE INVENTION

The present invention provides overcurrent protection on a single fuse for multiple circuits or multiple conductive pathways of a single circuit. The fuses include a plurality of fuse links and fuse elements, which in one preferred embodiment are plated, adhered or otherwise secured to an insulative substrate. The corresponding fuses are also surface mountable to a parent PCB.

Figure 1A:
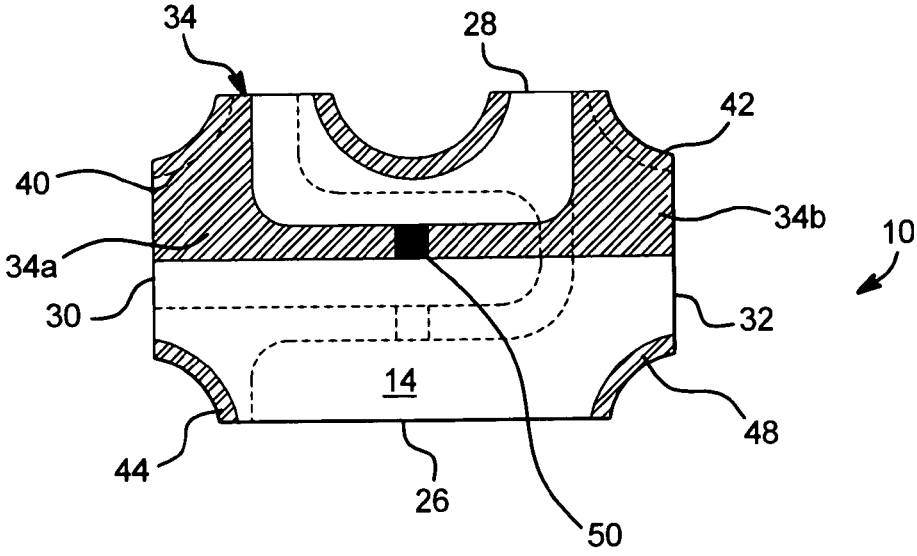
FIGS. 1A to 1C are top, front and bottom views, respectively, of one embodiment of the fuse of the present invention wherein multiple fuse links have a serpentine arrangement.
Figure 1B:
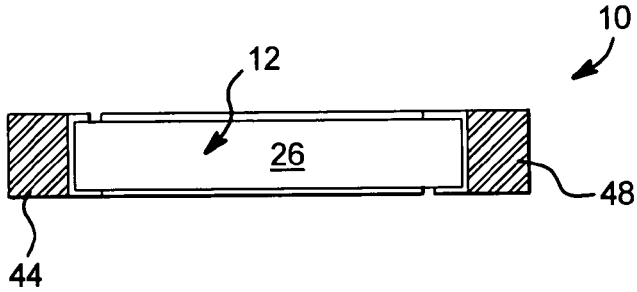
Figure 1C:
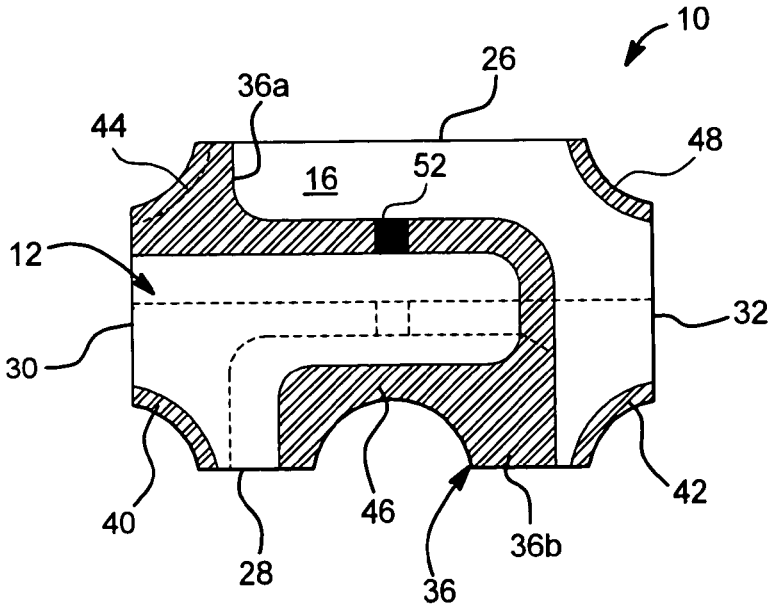

Referring now to the drawings, and in particular to FIGS. 1A to 1C, one embodiment of a dual fuse link surface-mountable fuse of the present invention is illustrated by fuse 10. Fuse 10 includes a substrate 12 that has a top 14 and a bottom 16. Substrate 12 also has a front 26, a back 28, a left side 30, and a right side 32. Fuse 10 includes separate conductive pathways or fuse links 34, 36 attached to the top and bottom surfaces 14, 16, respectively. Fuse link 34 includes separate conductive pathways 34*a* and 34*b* (referred to collectively as fuse link 34). A fuse element 50 is placed on the interface between conductive pathways 34*a* and 34*b*, which is approximately in the middle of fuse link 34. Likewise, fuse link 36 includes two separate pathways 36*a* and 36*b* (referred to collectively as fuse link 36). A fuse element 52 is placed on the interface between pathways 36*a* and 36*b*, approximately in the middle of fuse link 36. First fuse link 34 and fuse element 50 are located on top 14 of substrate 12. Second fuse link 36 and fuse element 52 are located on the bottom 16 of substrate 12.

Substrate 12 can be made of any suitable insulative material. In a preferred embodiment, the insulative material is both electrically and thermally insulative. Suitable materials for substrate 12 include FR-4, epoxy resin, ceramic, resin coated foil, teflon, polyimide, glass and any suitable combination thereof.

Fuse links 34 and 36 in one embodiment are or include copper traces. Copper traces are etched onto substrate 12 via any suitable etching or metalizing process. One suitable process for etching the metal onto substrate 12 is described in U.S. Pat. No. 5,943,764 ("the '764 patent"), assigned to the assignee of the present invention, the entire contents of which are incorporated herein by reference. Another possible way to metalize substrate 12 of fuse 10 is to adhere the fuse links 34 and 36 to substrate 12. One suitable method for adhering the fuse links 34 and 36 of fuse 10 to substrate 12 is described in U.S. Pat. No. 5,977,860, assigned to the assignee of the present invention, the entire contents of which are incorporated herein by reference.

The fuse elements 50 and 52 in an embodiment include a combination of tin and lead, e.g., solder. The fuse elements 50 and 52 have a lower melting temperature than do fuse links 34 and 36. To that end, fuse elements 50 and 52 can be any metal or alloy having a lower melting temperature than the fuse links 34 and 36.

As illustrated, the fuse links narrow as they extend towards an interface between pathway halves 34*a* and 34*b* and 36*a* and 36*b*. The narrowed portion of fuse links 34 and 36 is the most likely the place for the pathways to open upon an overcurrent condition. The addition of fuse elements 50 and 52 helps to ensure that the corresponding fuse link opens at the narrowed location e.g., at tin-lead spots 50 and 52. When the fuse elements 50 and 52 heat up due to an overcurrent condition, the alloy melts and causes an increased point of heat transfer on the copper traces 34 and 36. Those points of the copper traces in turn melt before other points along the fuse links 34 and 36. In this way, the point at which either of the fuse links 34 or 36 opens is controllable and repeatable.

As illustrated, conductive pathway 34*a* extends to a terminal 40 located at one of the corners of substrate 12. As seen in FIG. 1A, conductive pathway 34*b* extends to a second terminal 42 located at a different corner of substrate 12. As seen in FIG. 1C, terminals 40 and 42 of fuse link 34 in one embodiment extend from the top 14, down sides 30 and 32 and cover a portion of the bottom 16 of substrate 12. Extending the terminals along multiple surfaces of the substrate enables each of the fuse links to be tested diagnostically from one side of the fuse or without having to flip the fuse, e.g., after it has been mounted to a parent printed circuit board ("PCB").

FIG. 1C illustrates the terminals 44 and 46 of second serpentine shaped fuse link 36 having second fuse element 52. As seen in FIG. 1C, conductive pathway 36*a* extends to terminal 44, which is located at a third corner of substrate 12. Conductive pathway 36*b* extends to terminal 46, which is located along the back 28 of substrate 12. As seen in FIGS. 1A and 1B, terminal 44 extends up side 30 and front 26 and along a portion of top 14 of substrate 12. Likewise, terminal 46 extends up back 28 and along a portion of top 14 of substrate 12.

As seen in FIGS. 1A to 1C, fuse links 34 and 36 do not extend to one of the four corners of substrate 12. Nevertheless, that fourth corner is metalized along a portion of the top 14, front 26, side 32 and bottom 16 of substrate 12. That is, a fourth terminal 48 is provided that does not connect electrically to either of the fuse links 34 and 36.

Separate terminal 48 is provided for multiple reasons. First, a metallization at the fourth corner of substrate 12 enables fuse 10 to be soldered properly to the parent PCB. Enabling all four corners of fuse 10 to be soldered (e.g., reflow soldered) to the parent PCB helps to ensure that fuse 10 is mounted flushly on the PCB and is not tilted or angled upward from one or more sides or corners of fuse 10. Dummy terminal 48 balances surface tension forces when fuse 10 is soldered to the PCB, so that fuse 10 is aligned correctly in a X-Y or planar direction along the surface of the parent PCB. Fourth metallization 48 also enables fuse 10 to be secured at all four corners, strengthening the connection between fuse 10 and the parent PCB. Terminal 48 may also help diagnostically.

A further reason to metalize the fourth corner with dummy terminal 48 is to streamline the manufacturing process. As discussed in the '764 patent, one of the last steps in manufacturing fuse 10 is to dice or cut individual fuses from a large sheet of multiple fuses. A process very similar to that described in the '764 patent can be used to produce fuse 10. Accordingly, fuse 10 at a point in the manufacturing step is adjacent to up to eight other fuses (four lateral and four diagonal). The quarter circle at dummy terminal 48 is adjacent to quarter circles of three terminals of three other fuses. The four quarter circles of four fuses together form a bore or hole. It is easier to plate the entire hole than it is to not plate the dummy terminal 48 portion and plate instead only threequarters of the hole for actual terminals of the other fuses. For multiple reasons, dummy terminal 48 is desirable.

As discussed in the '764 patent, it may be desirable to place multiple conductive layers on one or more of the terminals 40, 42, 44, 46 and 48. The conductive layers of terminals 40 to 46 can include any number and combination of layers of copper, nickel, silver, gold, lead-tin and other suitable metals. The terminals can have the same or different numbers and types of conductive layers.

The configuration of the terminals in FIGS. 1A to 1C is advantageous for multiple reasons. First, fuse links 34 and 36 and associated elements 50 and 52 are thermally decoupled from one another. For one reason, fuse elements 50 and 52 are placed on opposite sides of substrate 12 from one another. Also, fuse elements 50 and 52 are misaligned laterally or in a planar direction with respect to each other. That is, the elements are not placed directly above and below one another. Instead, the spacing or arrangement of elements 50 and 52 is offset as seen in top and bottom views, respectively, of FIGS. 1A and 1C. Spacing the elements 50 and 52 apart in three directions helps to insulate the elements from one another to prevent false triggering.

Another advantage of the fuse link configuration shown in FIGS. 1A to 1C is that fuse links and fuse elements may be sized or structured differently to produce a differently rated fuse link. For example, fuse link 34 (including separate pathways 34*a* and 34*b*) and fuse element 50 located on the top 14 of substrate 12 may be rated differently, e.g., ten amps, than is bottom side fuse link 36 (including pathways 36*a* and 36*b*) and fuse element 52, which could be rated for five amps or fifteen amps. Generally, either of the fusible links and associated fuse elements can be rated for one amp to[Please provide amperage limits].

The non-symmetrical arrangement of the fuse links on the top 14 and bottom 16 of fuse 10 makes an improper mounting of fuse 10 more difficult. That is, the mounting footprint of terminals 40 and 42 of the fuse link 34 and fuse element 50 is different than (e.g., will not mate or mount to mounting pads that mate with terminals 44 and 46) the mounting footprint of fuse link 36 and terminals 44 and 46 located on the bottom 16 of fuse 10. The reverse is also true. That is, the mounting pads of a parent PCB that mate with terminals 44 and 46 of fuse link 36 will not mate with and cannot mount to terminals 40 and 42 of fuse link 34. The configuration of fuse links 34 and 36 on fuse 10 therefore prevents or tends to prevent an assembler from placing an improperly rated fuse in a circuit or improperly mounting fuse 10.

Although not illustrated, a portion of the top 14 and bottom 16 of fuse 10 can be covered with and an insulative protective coating. The protective coating forms a substantially air tight and moisture tight seal over the fusible links 34 and 36 as well as their fuse elements 50 and 52. At least a portion of each of terminals 40, 42, 44, 46 and 48 remains exposed so that fuse 10 may be mounted to the parent PCB. The protective layer inhibits corrosion and oxidation of the fusible links 34 and 36 as well as fuse elements 50 and 52. The protective coating also protects those items from mechanical impact and aids in the distribution and manufacture of fuse 10, for example, by providing a surface on which a tool can apply a vacuum to pick and place fuse 10. A protective layer also helps to control the melting, ionization and arching that occur when one of the fusible links opens upon an overload condition. To that end, the coating provides desired arch-quenching during the opening of one of the fusible links of fuse 10.

The coating in one embodiment includes a polymer, such as a polyurethane gel or paste that can be stenciled printed or screen printed onto the desired locations of fuse 10. One suitable polyurethane is made by Dymax Corporation.

The teachings previously described with respect to fuse 10 of FIGS. 1A to 1C are applicable to the remaining fuses discussed herein. The remaining fuses differ primarily in the configuration and arrangement of the fuse links, fuse elements and associated terminals. Each of the materials discussed above for the substrate, fusible links, terminals and fuse elements is applicable to each of the remaining fuses. For ease of illustration, those materials, methods of fabrication or application are not repeated in all cases for each of the foregoing fuses.

For purposes of illustration, each of the fuses is given a name that is descriptive of the shape or relative configuration of the fuse links and fuse elements on the respective fuses. Accordingly, fuse 10 described in FIGS. 1A to 1C is labeled a serpentine fuse because of the serpentine shape of fuse link 36. Fuse 60 discussed in FIGS. 2A to 2C is accordingly labeled a asymmetrical, parallel fuse.

Symmetrical, parallel fuse 60 includes many of the same components described above for the serpentine fuse 10 of FIGS. 1A to 1C. In particular, fuse 60 includes an insulative substrate 62 having a top 64, bottom 66, back 68, sides 70 and 72 and a front 76. Fuse links 84 and 86 are plated, etched, adhered or otherwise secured to substrate 62. Fuse link 84 includes conductive pathways 84*a* and 84*b* that extend to terminals 90 and 92, respectively. Fuse link 86 includes conductive pathways 86*a* and 86*b* that extend to terminals 94 and 96, respectively. A fuse element 100 is placed on fuse link 84 to help provide a definite point at which fuse link 84 opens upon an overcurrent condition. Likewise, a fuse element 102 is placed on fuse link 86 to provide a definite point at which fuse link 86 will open.

Fuse links 84 and 86 are sized (thickness and width) to open at a set and desired overcurrent level. Fuse links 84 and 86 may be rated the same or differently from one another. Given the parallel and symmetrical arrangement of the fuse links and terminals of fuse 60, it may be desirable for the fuse links to have the same rating, so that the fuses are mounted properly no matter which surface 64 or 66 of substrate 12 is placed onto the parent PCB.

Figure 2A:
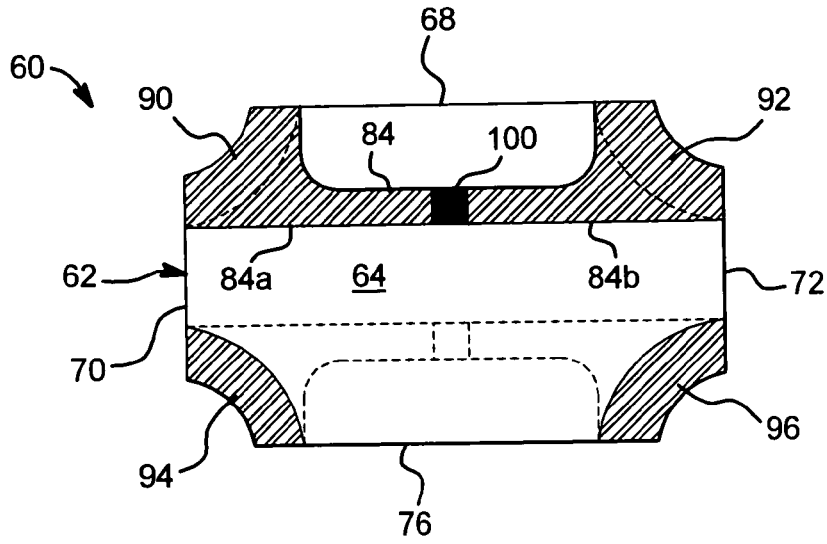
FIGS. 2A to 2C are top, front and bottom views, respectively, of another embodiment of the surface mount fuse of the present invention, wherein multiple fuse links have an asymmetrical, parallel relationship.
Figure 2B:
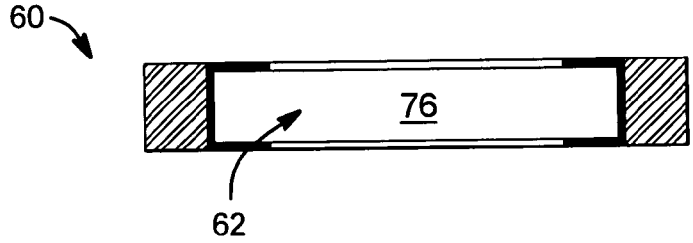
Figure 2C:
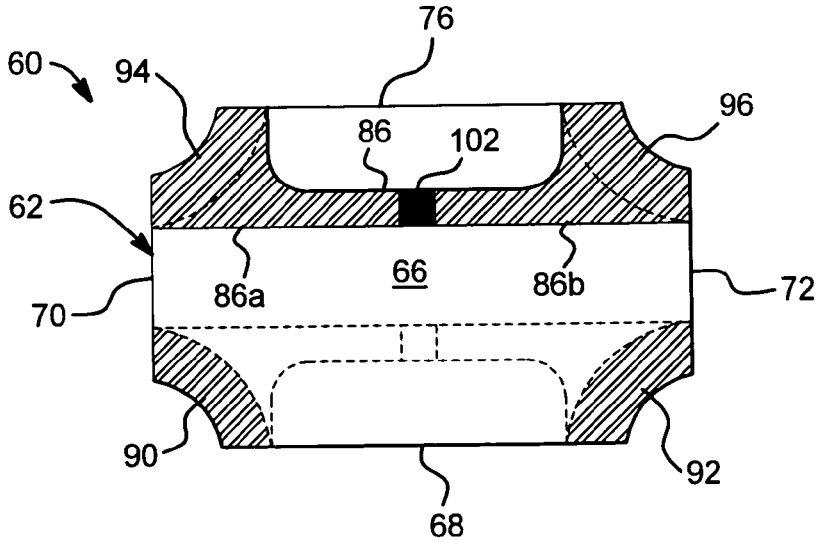

As seen in FIGS. 2A to 2C, terminals 90 to 96 each extend down/up respective sides 70 and 72, front 76 and rear 68 of substrate 62. The terminals further extend along a portion of the opposite top 64 or bottom 66, respectively. Unlike the fuse 10 of FIGS. 1A to 1C, all four corners of fuse 60 are consumed by terminals 90 to 96, which each extend from one of the fusible links 84 and 86. Accordingly, fuse 60 of FIGS. 2A to 2C does not need a dummy terminal.

In the parallel, symmetrical arrangement of fuse 60, or with any of the fuses described herein, it is expressly contemplated to provide two substrates 62 that sandwich an inner metallic layer having a third fusible link and element, third set of conductive pathways that extend to a third set of terminals. The third set of terminals (not illustrated) in one embodiment are metallized on the outside of the two substrates 62, for example at front 76 and back 68 or otherwise away from the corners where terminals 90 to 96 are located. In this way, the present invention provides for more than two fuse links and fuse elements per assembly. The present invention also includes the provision of any suitable number of insulative substrates and conductive layers located between the insulative layers. Each of the separate fusible links extends to a terminal located on at least one outer surface of the fuse. The three or more terminals may each be rated the same, some rated differently, each rated differently or any combination thereof.

Fuse 60 includes a protective coating (not illustrated) located at desired places, e.g., covering the fusible links 84 and 86 and fuse elements 100 and 102. The protective coating is made of any of the materials discussed above in connection with fuse 10 of FIGS. 1A to 1C.

Figure 3A:
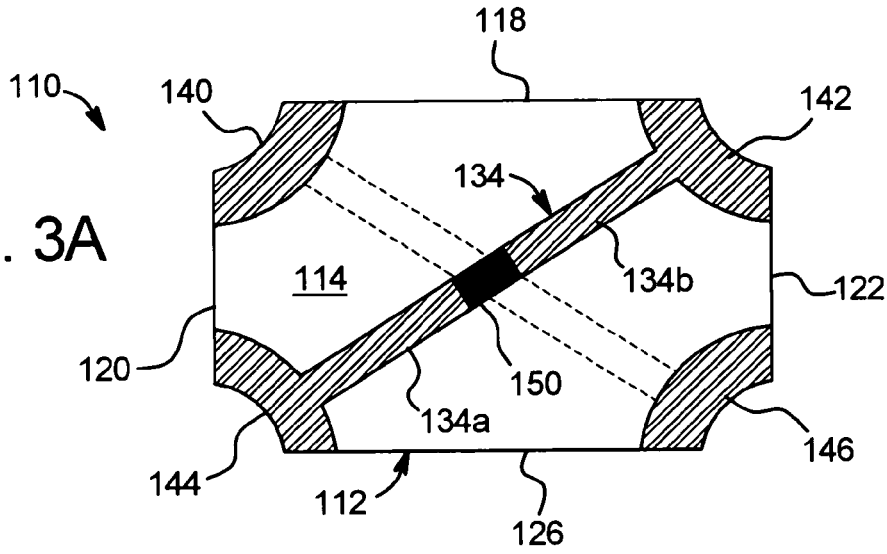
FIGS. 3A to 3C are top, front and bottom views, respectively, of a further embodiment of the surface mount fuse of the present invention wherein multiple fuse links have an asymmetrical, X-shaped relationship.
Figure 3B:
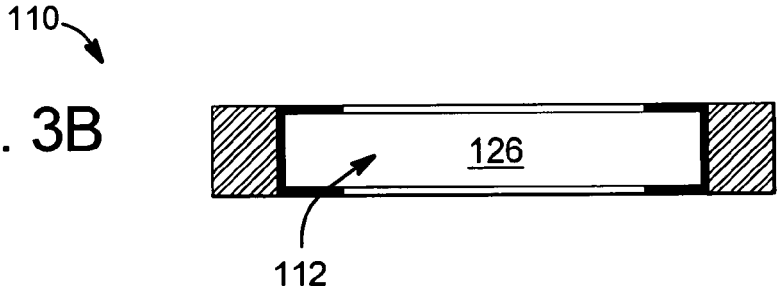
Figure 3C:
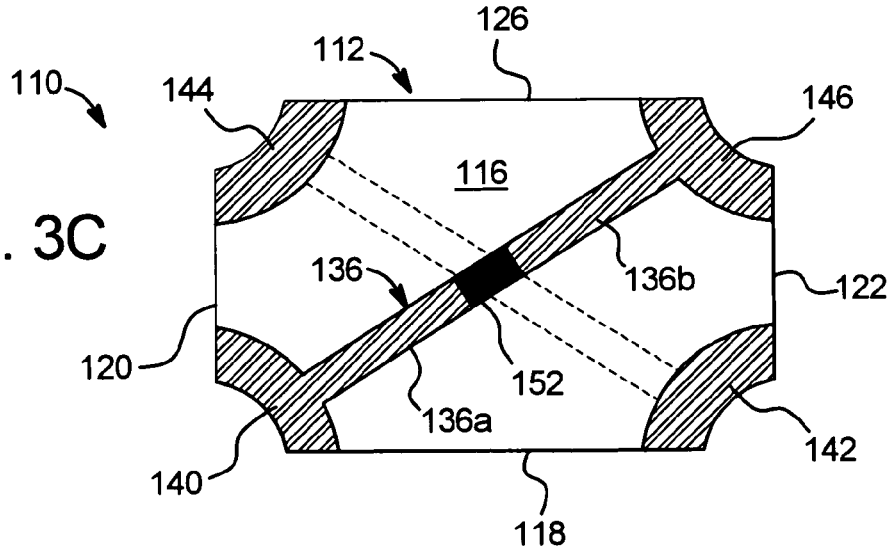

Refer now to FIGS. 3A to 3C, a third fuse 110 is illustrated. Fuse 110 includes many of the same components as fuses 10 and to 60 described above. Fuse 110 for apparent reasons is called an X-shaped, symmetrical fuse. X-shaped, symmetrical fuse 110 includes a substrate 112. Substrate 112 is made of any of the materials described above. Substrate 112 includes a top 114, a bottom 116, sides 120 and 122, a front 126 and a back 118.

A fuse link 134 including conductive pathways 134*a* and 134*b* is placed on the top 114 of fuse 110 via any of the methods described above. Likewise, fuse link 136 including conductive pathways 136*a* and 136*b* is placed on the bottom 116 of substrate 112 via any of the methods described herein. Fuse links 134 and 136 include fuse elements 150 and 152, respectively.

Conductive pathways 134*a* and 134*b* of fuse link 134 extend to terminals 144 and 142, respectively. Likewise, pathways 136*a* and 136*b* of fuse link 136 extend to terminals 140 and 146, respectively. Terminals 140 to 146 cover each of the corners of substrate 112. Accordingly no dummy terminal. (like the one shown in FIGS. 1A to 1C) is provided. Terminals 140 to 146 extend down/up the front, back and sides of substrate 112 and cover a portion of the surface opposite of their respective fuse links, as has been described herein.

X-shaped, symmetrical fuse 110 is well suited to have an inner third or forth etc., metal layer, comprising additional fuse links and fuse elements. Also, due to the symmetrical nature of fuse 110, it may be desirable for fuse links 134 and 136 to have the same current ratings so that fuse 110 may be mounted in multiple directions, without fear of protecting a circuit with an improperly rated overcurrent protection device.

Links, terminals and elements 150 and 152 are made of any of the materials described above. Fuse elements 150 and 152 as shown are aligned with one another with respect to an axis extending out of the page. It may be desirable for thermal coupling reasons to alternatively offset the placement of the fuse element. Fuse 110 also includes a suitable protective coating in one embodiment.

Figure 4A:
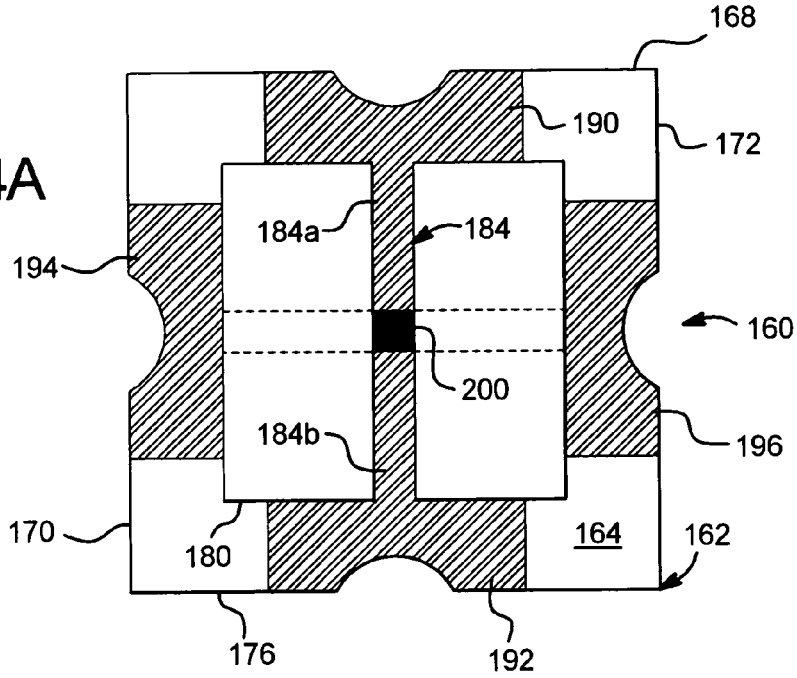
FIGS. 4A to 4C are top, front and bottom views, respectively, of yet another embodiment of the surface mount fuse of the present invention, wherein multiple fuse links have an asymmetrical, cross-shaped configuration.
Figure 4B:
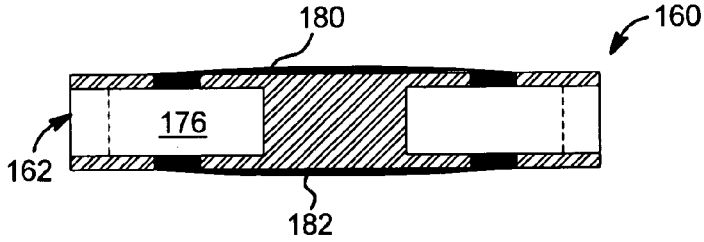
Figure 4C:
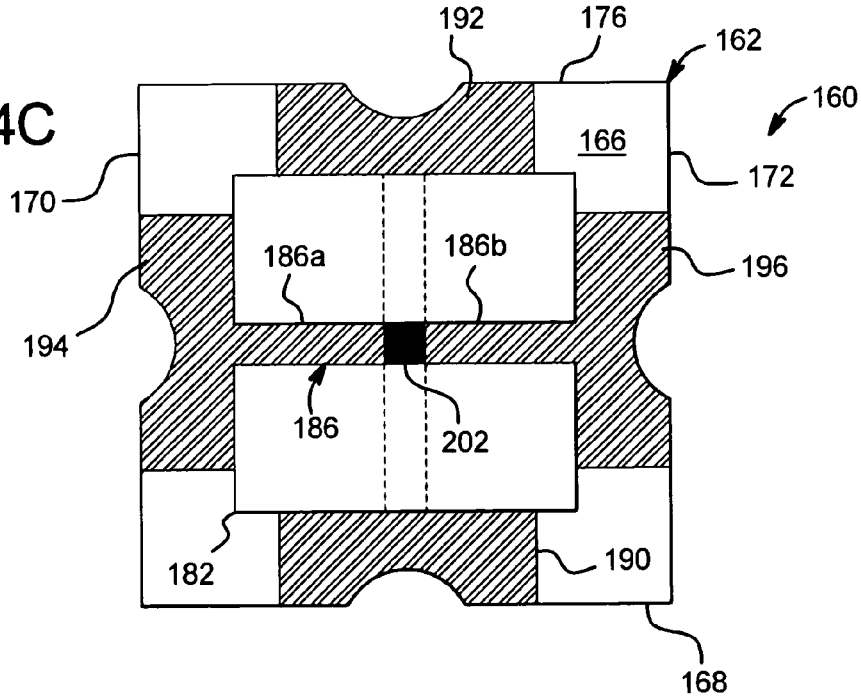

Referring now to FIGS. 4A to 4C, a further alternative fuse 160 is illustrated. Fuse 160 includes a substrate 162 and fuse links 184 and 186. Fuse link 184 is placed on the top 164 of substrate 162. Fuse link 186 is placed on the bottom 166 of substrate 162. Substrate 162 also includes sides 170 and 172, front 176 and rear 168.

Fuse 160 is different from the other fuses shown and described herein because the corners of substrate 162 are not metallized, rather the inner portions of sides 170 and 172, front 176 and rear 168 are metallized. The centers of those portions are shown having semi-circular cut-outs or bores. The bores are originally completely circular when a plurality of fuses 160 are made in a sheet, before the fuses 160 are separated or diced into the individual fuses 160. Nevertheless, because each front, back and side of fuse 160 includes a terminal or metallization, fuse 160 is solderable to a parent PCB without experiencing unbalanced surface tension forces and is or tends to be auto-alignable without additional dummy terminals.

Fuse 160 for apparent reasons is called a cross-shaped symmetrical fuse. Fuse links 184 and 186 may be rated the same or differently. In one embodiment because fuse 160 is symmetrical and fuse links 184 and 186 are rated for the same ampage so that the fuse may be soldered in multiple configurations without fear of improper mounting. Fuse links 184 and 186 include fuse elements 200 and 202, respectively, which may be of any the types described herein.

It should be appreciated from the foregoing examples that the fuses and substrates of the present invention can have many different shapes, fuse link configurations and terminal configurations. The fuses and substrates are also be sized to support a fuse having any suitable desired rating. The overall dimensions of the fuses can be an order of 1/16 inch (1.59 mm) and be generally square in shape or have rectangular dimensions. The thickness of the substrate or fuse can be on the order of a 1/64 inch (0.40 mm). In alternative embodiments, the dimensions of the fuse are bigger or smaller than the listed dimensions as desired and/or thicker than the thickness listed. The thickness of the traces in one embodiment is on the order of 5 mils (0.13 mm).

A first protective coating 180 is placed on the top 164 of substrate 162. A second protective coating 182 as seen in FIG. 4B is placed on the bottom 166 of substrate 162. Coatings 180 and 182 are made of any of the materials discussed above and provide each of the benefits discussed herein. Any of the fuses discussed herein can have first and second protective layers.

Figure 5A:
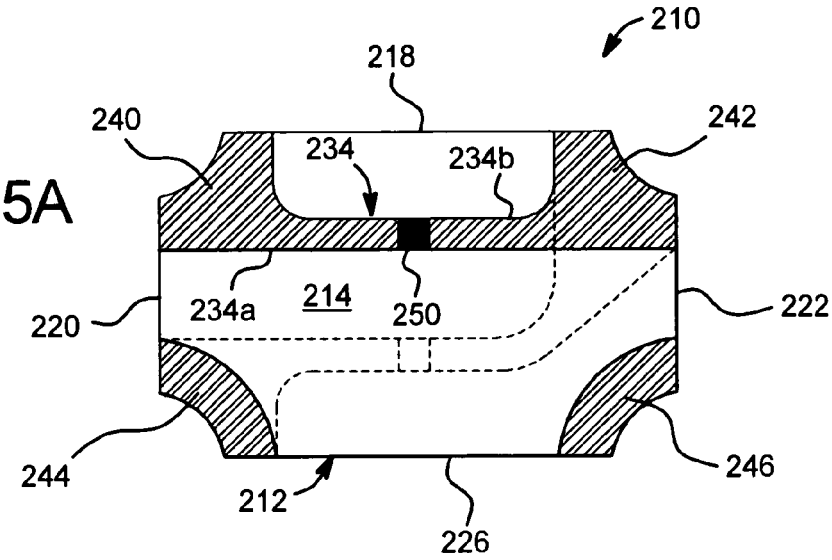
FIGS. 5A to 5C are top, front and bottom views, respectively, of a still further embodiment of the surface mount fuse of the present invention, wherein multiple fuse links have multiple load terminals fusibly connected to a single or ground or common terminal.
Figure 5B:
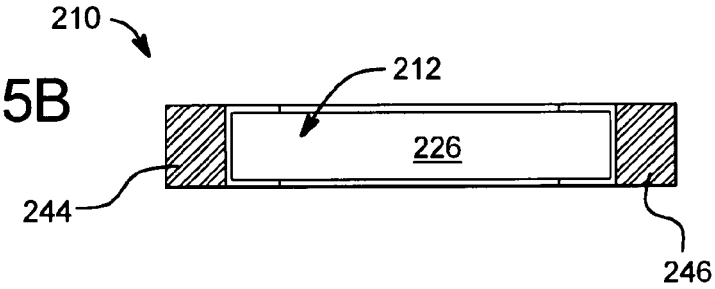
Figure 5C:
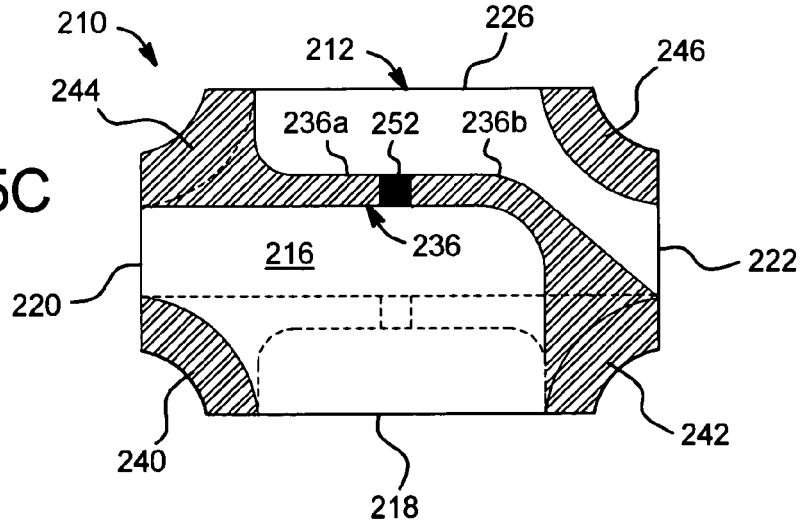

Referring now to FIGS. 5A to 5C, an alternative embodiment of the surface mount use of the present invention is illustrated by fuse 210. Fuse 210 as illustrated includes a single ground or common terminal 242 that connects electrically via separate fuse links 234 and 236 to load terminals 240 and 244.

Fuse 210 includes an insulative substrate 212. Insulative substrate 212 includes a top 214, a bottom 216, sides 220 and 222, a front 226 and a rear 218. A fuse link 234 is placed on the top 214 of substrate 212. Fuse link 234 includes a first conductive pathway 234*a* that extends to load terminal 240. Fuse link 234 includes a second conductive pathway 234*b* that extends to ground or common terminal 242.

Fuse link 236 is placed on the bottom 216 of substrate 212 of fuse 210. Fuse link 236 includes a first conductive pathway 236*a* that extends to load terminal 244. Fuse link 236 includes a second conductive pathway 236*b* that extends to ground or common terminal 242.

A fuse element 250 is placed fuse link 234. A fuse element 252 is disposed on fuse link 236. Fuse links 234 and 236 are secured to substrate 212 via any of the embodiments discussed above. Likewise, fuse elements 250 and 252 are made according to any of the embodiments discussed herein. Fuse elements 250 and 252 as well as fuse links 234 and 236 can be rated the same or differently. The fuse links are separated from one another in three dimensions for thermal decoupling. The non-symmetrical relationship between fuse links 234 and 236 also makes fuse 210 well suited for different current ratings because the fuse 210 is difficult to mount improperly.

As seen in FIGS. 5A and 5C, three of the four corners of substrate 212 are metallized via terminals 240, 242 and 244. For reasons discussed above, dummy terminal 246 is provided in one preferred embodiment. As further illustrated, each of the terminals extends around portions of three different sides of substrate 212. Terminals 240 to 246 can each be plated with multiple conductive layers, such as multiple copper layers, nickel, silver, gold or lead-tin layers as can the terminals of any of the fuses discussed herein.

Fuse 210 protects multiple load lines that lead to a single ground or common terminal. It should be appreciated that it is also possible to provide two substrates 212 sandwiching an internal metal layer, which enables three or more load terminals to be fusibly connected to a single ground or common terminal 242. Fuse 210 protects multiple load devices having a common negation or ground line.

Figure 6A:
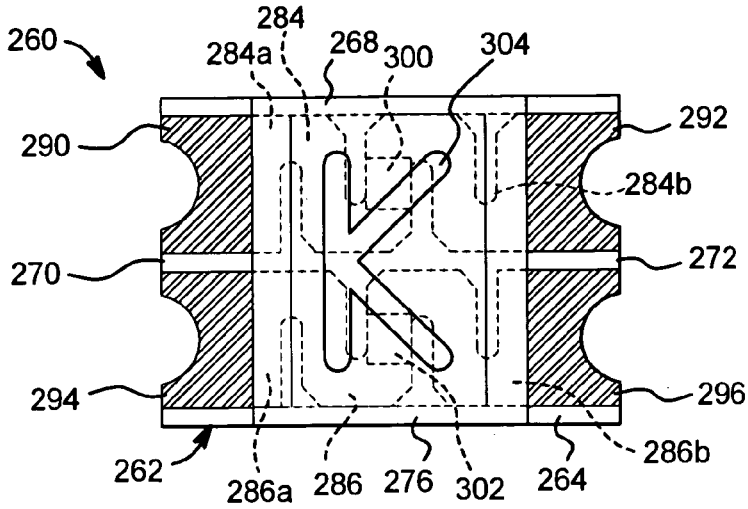
FIGS. 6A to 6C are top, front and bottom views, respectively, of yet a further embodiment of the surface mount fuse of the present invention having multiple fusible links of the same or different current rating located on a single side of the fuse.
Figure 6B:
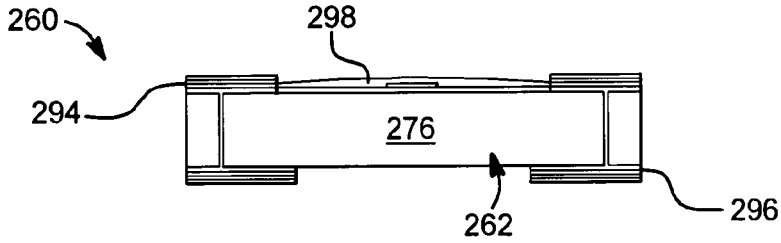
Figure 6C:
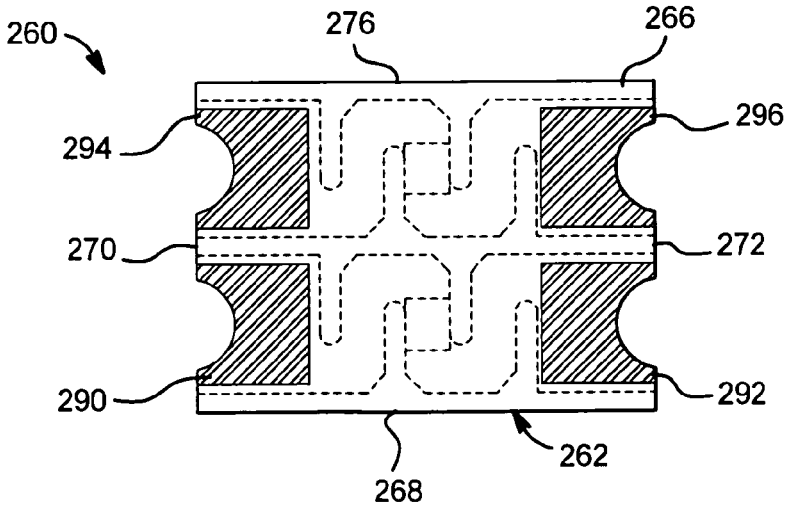

Referring now to FIGS. 6A and 6C, a further alternative embodiment of the present invention is illustrated by fuse 260. In each of the previous embodiments, the fuse links and fuse elements were thermally insulated from one another by being placed on opposite sides of the insulative substrate. Also described herein, the fuse links and fuse elements can be separated by multiple substrates, for example, when three or more fuse links are provided and in an X-Y or planar direction. Fuse 260 on the other hand illustrates an alternative embodiment where multiple fuse links 284 and 286 each having a fuse element 300 and 302, respectively, are placed on a same surface 264 of substrate 262 of fuse 260. It is possible that a planar separation between fuse links 284 and 286 can be made large enough to provide both links on the same surface of the substrate. It is therefore contemplated to place multiple fuse links on multiple surfaces, for example, to provide four total fuse links in one device.

Fuse 260 includes a substrate 262 as mentioned. Substrate 262 includes a top 264, a bottom 266, sides 270 and 272, a front 276 and a rear 268. As discussed, fuse links 284 and 286 are placed on the same top surface 264 of fuse 260. Fuse links 284 and 286 and their respective fuse elements 300 and 302 are rated the same or differently as desired. The fuse links and fuse elements are applied via any of the methods discussed above and include and of the different materials disclosed herein.

Fuse link 284 includes a conductive pathway 284*a* that extends to terminal 290. A conductive pathway 284*b* of fuse link 284 extends to terminal 292. Likewise, conductive pathway 286*a* of fuse link 286 extends to terminal 294, while conductive pathway 286*b* of fuse link 286 extends to terminal 296. Terminals 290 to 296 each extend along three sides of substrate 262 as seen in FIGS. 6A and 6C. FIG. 6B further illustrates that the terminals can be plated with multiple conductive layers as discussed above.

Because fuse 260 is relatively symmetrical, the surface tension forces created during soldering should be balanced, making the mounting of fuse 260 to a parent PCB a process that is at least somewhat auto-aligning. The fuse is alternatively configured non-symmetrically, for example, when providing fuse links with different current ratings.

A protective coating 298 is applied over the fuse elements and fuse links. The fuse links and elements are therefore shown in phantom in FIG. 6A. Protective coating 298 can be of any of the types discussed above. Further, fuse 260 includes marking or branding indicia 304, which includes any suitable information, such as fuse rating information, manufacturer information and the like. Any of the embodiments discussed herein can have indicia 304.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A surface mount fuse comprising:

an insulative substrate;

a first terminal secured to the substrate;

a second terminal secured to the substrate;

a third terminal secured to the substrate;

a first fuse link connected electrically to the first and second terminals; and a second fuse link connected electrically to the third terminal, wherein the first fuse link is disposed on a top surface of the substrate and the second fuse link is disposed on a bottom surface of the substrate.

2. The surface mount fuse of claim 1, wherein at least a majority of the first terminal and at least a majority of the second terminal are located on the top surface of the substrate and at least a majority of the third terminal is located on the bottom surface of the substrate.

3. The surface mount fuse of claim 1, wherein the substrate further includes side surfaces, and wherein at least one of the terminals extends along multiple surfaces of the substrate.

4. The surface mount fuse of claim 1, wherein at least one of the terminals extends along opposite side surfaces of the substrate.

5. The surface mount fuse of claim 1, wherein the fuse links have different current ratings.

6. The surface mount fuse of claim 1, wherein the fuse links have approximately the same current rating.

7. The surface mount fuse of claim 1, which includes a fourth terminal connected electrically to the second fuse link and the third terminal.

8. The surface mount fuse of claim 1, wherein at least one additional portion of the insulative substrate is metallized for purposes of solderability or manufacturability.

9. The surface mount fuse of claim 1, wherein the insulative substrate is made of a material selective from the group consisting of: FR-4, epoxy resin, ceramic, resin coated foil, polytetraflouroethylene, polyimide and glass.

10. The surface mount fuse of claim 1, wherein at least one of the terminals and fuse links is copper.

11. The surface mount fuse of claim 1, wherein at least one of the fuse links includes a fuse element that provides a point at which the fuse link opens upon an overcurrent condition.

12. The surface mount fuse of claim 11, wherein the fuse element includes a plurality of metals.

13. The surface mount fuse of claim 1, wherein the terminals and fuse links are applied to the substrate via a process selected from the group consisting of: plating and adhesion.

14. The surface mount fuse of claim 1, wherein at least one of the fuse links is covered with a protective coating.

15. The surface mount fuse of claim 1, wherein the first and second fuse links terminate at three corners and a side of the substrate.

16. The surface mount fuse of claim 15, wherein a fourth corner of the substrate is also metallized for manufacturability or solderability.

17. The surface mount fuse of claim 1, wherein the first and second fuse links are located with respect to each other in a non-symmetrical arrangement.

18. The surface mount fuse of claim 1, wherein the first and second fuse links are located with respect to each other in a misalignment arrangement.

19. A method of providing circuit protection comprising the steps of:

placing differently rated surface-mounted fuse links on different surfaces of a single insulative substrate; and configuring terminals communicating electrically with the fuse links differently to prevent improper mounting of the terminals, wherein configuring the terminals differently includes extending the terminals communicating with a first one of the fuse links to different corners of the substrate and extending the terminals communicating with a second one of the fuse links to a side of the substrate and to either (i) another side of the substrate or (ii) another corner of the substrate.

* * * * *